US006315120B1

(12) United States Patent
Tally et al.

(10) Patent No.: US 6,315,120 B1
(45) Date of Patent: Nov. 13, 2001

(54) PORTABLE TOOL TRAY

(75) Inventors: Kevin L. Tally, Rural Clarinda, IA (US); Peter A. Siemen, Granada Hills, CA (US)

(73) Assignee: The Lisle Corporation, Clarinda, IA (US)

( * ) Notice: Subject to any disclaimer, the term of this patent is extended or adjusted under 35 U.S.C. 154(b) by 0 days.

(21) Appl. No.: 09/603,048

(22) Filed: Jun. 26, 2000

Related U.S. Application Data

(63) Continuation-in-part of application No. 09/415,786, filed on Oct. 8, 1999, now abandoned.

(51) Int. Cl.[7] ..... B65D 85/00; B65D 90/12; A47G 29/00

(52) U.S. Cl. ..... 206/373; 206/350; 206/561; 220/630; 220/632; 220/636; 248/146; 248/148; 248/346.2; 248/910

(58) Field of Search ..... 206/350, 373, 206/557, 561; 108/43, 44; 270/628, 630, 632, 634, 636; 248/146, 148, 346.05, 346.2, 910

(56) References Cited

U.S. PATENT DOCUMENTS

| | | | | |
|---|---|---|---|---|
| 2,219,974 | * | 10/1940 | Bellow | 220/632 |
| 2,916,184 | * | 12/1959 | Hartley et al. | 220/632 |
| 3,028,702 | * | 4/1962 | St. Cyr | 220/632 |
| 3,312,436 | * | 4/1967 | Beghetto, Jr. | 248/148 |
| 4,052,944 | * | 10/1977 | Jennings | 108/43 |
| 4,192,329 | * | 3/1980 | Swearingen | 248/694 |
| 4,788,916 | * | 12/1988 | Saxton | 108/43 |
| 4,964,600 | * | 10/1990 | Lee | 248/146 |
| 5,295,742 | * | 3/1994 | Knutson | 108/43 |

OTHER PUBLICATIONS

Cornwell Catalog, p. 17, dated 1998.
Mac Tool Catalog, p. 435, dated 1995.

* cited by examiner

*Primary Examiner*—Bryon P. Gehman
(74) *Attorney, Agent, or Firm*—Banner & Witcoff, Ltd.

(57) ABSTRACT

A portable tray includes a formed plastic receptacle including various compartments with a circumferential retainer ring cooperating with a flexible bag that is filled with bag fill material to provide a tray assembly which can be fitted on an uneven surface.

8 Claims, 3 Drawing Sheets

FIG. 3
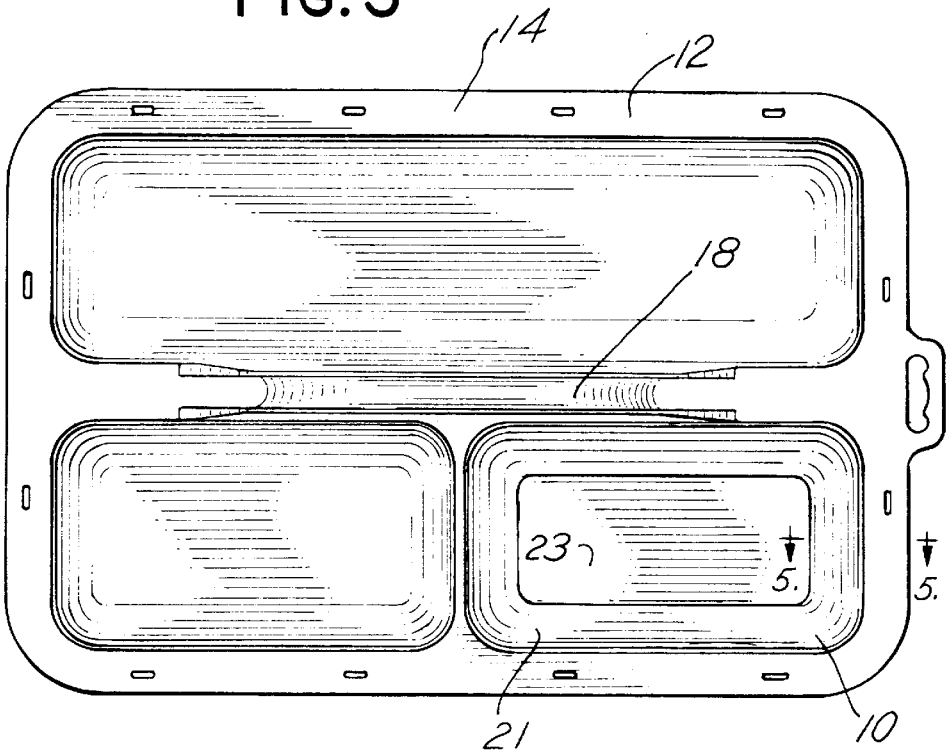
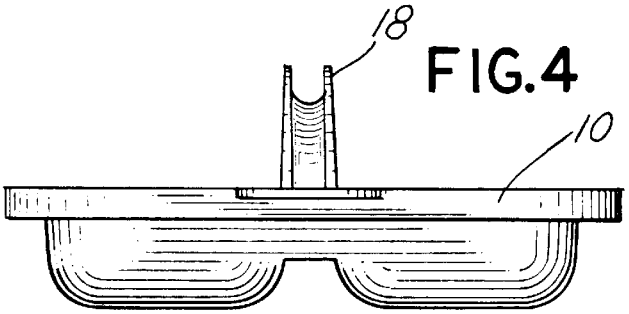
FIG. 4
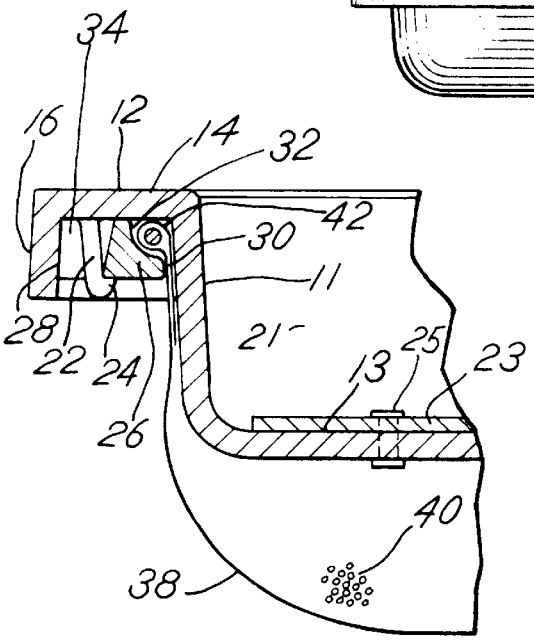
FIG. 5

PORTABLE TOOL TRAY

CROSS REFERENCE TO RELATED APPLICATION

This is a Continuation-In-Part of application Ser. No. 09/415,786, filed Oct. 8, 1999, now abandoned.

BACKGROUND OF THE INVENTION

In a principal aspect, the present invention relates to a portable tool tray, and more particularly to a portable tool tray which includes formed storage compartments supported on a bottom or underside which is capable of conforming to the shape of the surface upon which the tray is positioned.

Auto mechanics, workmen and the like often carry their tools from one job site to another, or when repairing a vehicle, from one vehicle to another. When at a worksite, tradesmen often find it necessary to place their tool tray on an uneven surface. If the tray has a rigid planar undersurface, balancing of the tray on a rigid undersurface is often difficult. Thus, it becomes necessary to find a flat or even surface. Alternatively, even if the tray is be carefully positioned, it may fall and the contents will spill. As a result, there has developed the need for a tool tray construction which obviates these problems.

SUMMARY OF THE INVENTION

Briefly, the present invention comprises a portable tool tray which includes a molded plastic upper section or receptacle with a circumferential rim. A retainer ring is provided which may be compatibly engaged with the rim. The retainer ring is attached to the rim to retain a bag filled with flexible bag fill material on the underside of the molded plastic receptacle or tray. The flexible, partially filled bag enables the bag to conform to an uneven surface when the tool tray is placed thereon. The bag, which may be filled with polystyrene beads, for example, or some other fill material, is partially filled so that the bag will assume the shape of the surface upon which it is placed thereby retaining the tray on that surface, even though the surface is somewhat uneven.

Thus, it is an object of the invention to provide an improved portable tool tray construction. A further object of the invention is to provide a portable tool tray which is easily assembled, easily repaired and may be used in a broad range of environments.

Yet another object of the invention is to provide a portable tool tray which includes a flexible bag on its bottom side or surface, thereby enabling the tray to conform with uneven surfaces and retaining the receptacle in position for access by a workman who has placed the tray.

Yet a further object of the invention is to provide a portable tool tray which is rugged, inexpensive, durable and highly portable.

Another object of the invention is to enable a user of the portable tool tray to place parts or hardware in the tray quickly and conveniently inasmuch as the tray may be located on any work surface close to a work area regardless of the type of work surface in contrast to magnetic tray holders which require a ferrous work surface;

Yet a further object of the invention is to provide a tray which is non-magnetic and thereby a tray which does not attract small metal shavings and other similar items which can scratch a surface upon which the tray is supported;

Another object of the invention is to provide a tray which tends to absorb vibration when placed on a surface, for example, an engine housing or machine housing, or the like, thereby reducing or eliminating undesirable noise and/or movements of parts in the tray; A further object of the invention is to provide a tray which may be made from entirely non-magnetic, non-conducting materials to thereby avoid any electrical hazard;

Another object of the invention is to provide a tray which can be easily lifted and removed from a surface and does not require additional force for removal such as would be required for the magnetic tray;

A further object of the invention is to provide a tray which may be positioned on a level, or a very uneven surface, or a surface which has an angle thereto;

Another object of the invention is to provide a tray which accommodates uneven surfaces and thereby avoids sliding from a surface;

These and other objects, advantages and features of the invention will be set forth in the detailed description which follows.

BRIEF DESCRIPTION OF THE DRAWING

In the detailed description which follows, reference will be made to the drawing comprised of the following figures;

FIG. 3 is a top plan view of the tool tray of FIG. 1;

FIG. 4 is an end view of the tray of FIG. 1; and

FIG. 5 is a cross sectional view of the tray of FIG. 3 taken along the line 5—5.

DESCRIPTION OF THE PREFERRED EMBODIMENT

Figure 1:
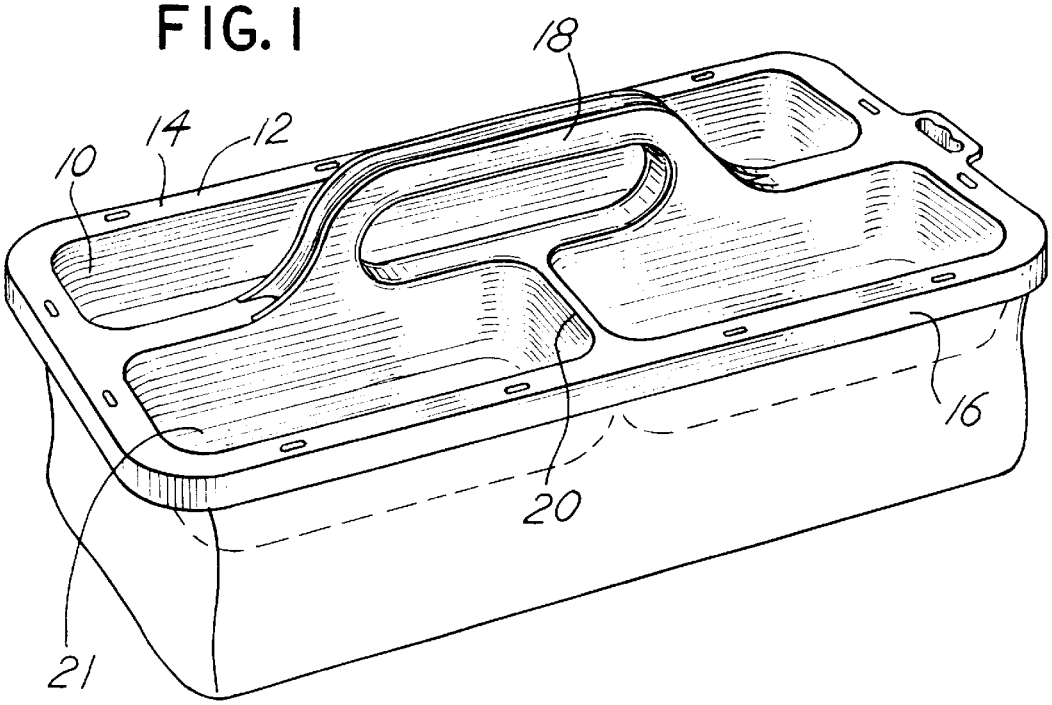
FIG. 1 is an isometric view of the tool tray of the invention.
Figure 2:
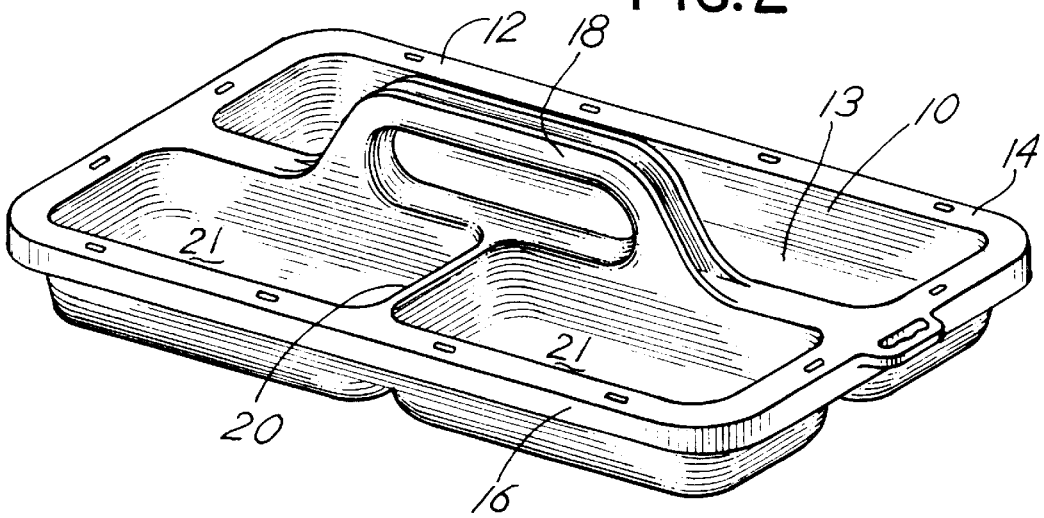
FIG. 2 is an exploded isometric view of the tool tray of FIG. 1.

Referring to the figures, the tool tray of the invention includes a molded plastic tray 10. The tray 10 may be made by any desired plastic molding operation, such as injection molding or the like. Typically, the tray 10 includes a peripheral rim 12 including a ledge or edge 14 which extends generally radially, outwardly about the entire radius or side of the tray 10 from a side wall 11. Side wall 11 connects to bottom wall 13. The rim 12 further includes a downwardly extending peripheral lip 16 at the outward extent of the ledge 14 spaced from side wall 11. A generally rectangular top plan view profile of the tray 10 is depicted. However, the profile of the tray 10 is not a limiting feature of the invention.

A handle 18 extending between opposite sides of the tray is integrally molded in the tray 10. Various dividers, such as dividing wall 20, define pockets 21 within the tray 10. Again, the particular arrangement of pockets 21 or compartments 21 within the tray 10 and the configuration of the tray 10 are not limiting features of the invention.

As depicted in FIG. 3, for example, the bottom of one or more of the pockets 21 may include a flat planer sheet or plate 23 of the magnetic material. The flat planer sheet will fit in the bottom of a pocket 21 and serves to maintain magnetic items such as nails and fasteners or tools within the pockets 21 so that they will not accidentally spill. Thus, the flat magnetic plate 23 is shaped and configured to conform to the bottom of a pocket 2land is retained therein by means of adhesive on the bottom side of the plate 23 or by some other fastening means such as a rivet 25 depicted in FIG. 5.

Depending downwardly from the ledge 14 is a molded clip 22. The clip 22 is integrally molded and made from a plastic material. The clip 22 includes a tab or lip 24.

A separate, molded or formed circumferential ring 26 is provided and shaped in size so as to fit within the space or region between the downwardly extending lip 16 and the side wall 11 of the tray receptacle 10. The ring 26 has a generally rectangular cross section with an outside surface 28 and an inside surface 30. A circumferential recess 32 is defined along an upper edge at the inside surface 30 of the ring 26. A series of slots, such as slot 34, are defined in the ring 26 at spaced intervals congruent in position with the downwardly depending clips 22 of ledge 14. Thus, as shown in FIG. 5, the clips 22 fit through the slots 34 thereby allowing lips 24 to grip or retain the ring 26 within the space between the lip 16 and the side wall 11.

A flexible bag 38 filled with bag fill material, such as polystyrene beads 40, includes a peripheral or closed loop edge 42. The closed loop edge 42 has a thickness greater than the thickness of the bag material. Thus, the loop edge 42 may be formed from the bag material or may be formed by folding the top edge of the bag material over a chord, wire 41 or the like. The loop edge 42 of the bag 38 is retained by the ring 26, and, more particularly, the recess 32 of the ring 26 holds or retains the edge 42. The bag 38 then fits between the inside edge or surface 30 of the ring and the wall 11.

The bag 38 may then be easily replaced by detaching clips 22 and removing the ring 26. Thus, if the bag 38 becomes worn or the fill 40, for some reason, degrades, the component parts may be replaced or repaired.

In use, the bag 38 being flexible and being partially filled (perhaps forty percent filled) with bag material 40, will conform to the uneven surface, for example, an automobile fender or the like. Thus, tools placed in the receptacle or tray 10 can be easily maintained in a safe and non-slidable position by the tool tray construction. The tray can be easily moved from place to place. The bag 38 may be easily replaced if it is damaged. Otherwise, the bag 38 is tightly retained in combination with tray receptacle 10.

Figure 6:
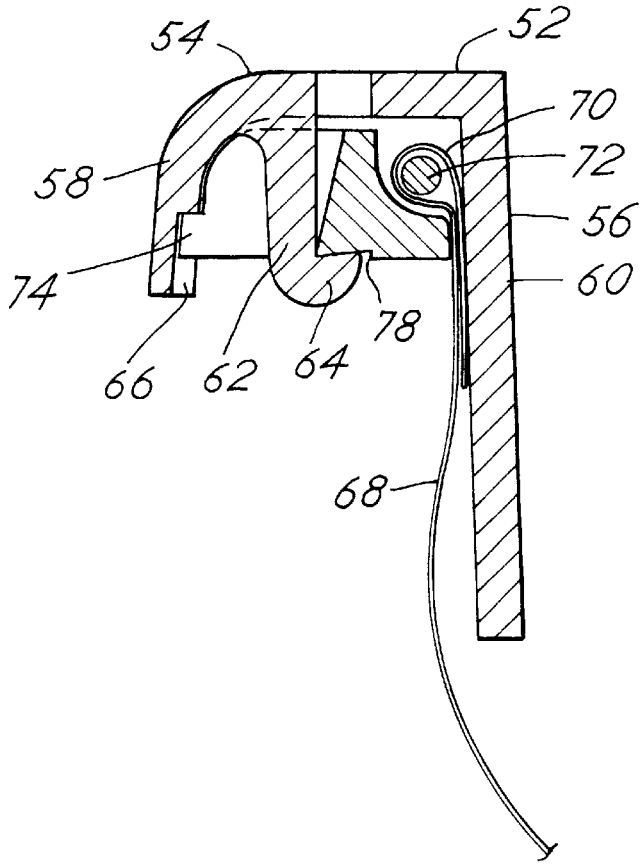
FIG. 6 is a cross sectional view of an alternative to the construction depicted in FIG. 5.
Figure 7:
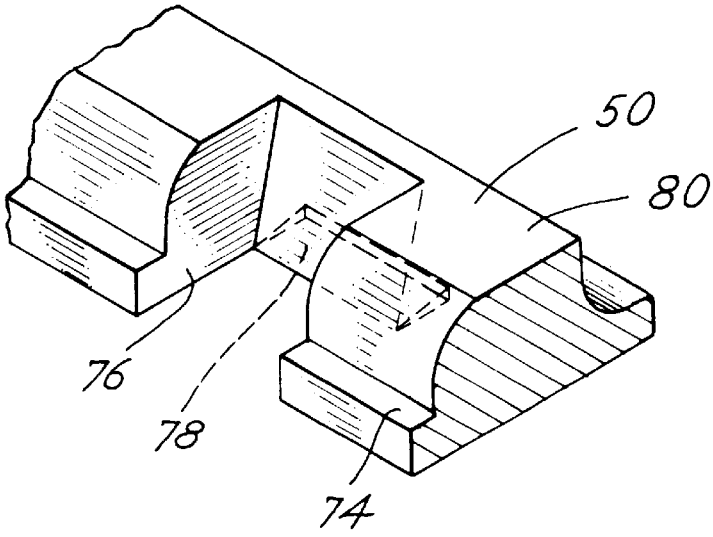
FIG. 7 is a cut away isometric view of the ring holder depicted in FIG. 6.

FIGS. 6 and 7 illustrate an alternative to the construction of the ring 26. A ring 50 has a shape or configuration which permits it to cooperate with a peripheral, horizontally outwardly extending ledge 52 of a rim 54 for a tray or container 56. The outwardly extending ledge 52 includes a downwardly depending peripheral lip 58. The lip 58 is spaced from side wall 60 of container 56. Downwardly depending locking clips or legs 62 with locking tabs 64 are provided at space intervals about the periphery of the container 56. The peripheral lip 58 further includes an upwardly extending slot or recess 66 on the inside thereof in opposed relation to the wall 60.

The retaining rim or ring 50 cooperates with the clip or legs 62 and also with fabric 68 having a formed loop 70 about a cord 72 to retain the fabric in position and locked against the outside face of the wall 60 of the container. The cross-sectional shape of the rim or ring 50 is designed and has tolerances to insure that the legs 62 retain the rim or ring 50 tightly and further effectively retains the fabric 68. Thus as depicted in FIGS. 6 and 7, the rim or ring 50 includes a rib 74 which projects outwardly and engages in the recess 66. The ring 50 further includes a cut-out section or passage 76 adapted to receive the clip or leg 62. The ring 50 further includes a cut out or recess 78 into which the projecting tab or foot 64 of clip 62 fits to facilitate guided retention of the ring 50. The ring 50 further includes a recess section 80 on its inside for receipt and holding of the fabric 68 and cord 72.

The downward extent of the clip 62 and the position of the tab or foot 64 in combination with the recess 78 and the dimension of the ring 50 serve to tightly retain the ring 50 and thus tightly retain the bag 68 attached to the container.

As explained, the construction of the ring 26, the loop edge 42, the clips 22, and the relationship of the clips 22 to the ring 26 may be altered. For example, the clips 22 may be placed on the ring 26 and fit into receptacles in the ledge 14. Other parts may be reversed. Thus, while in the preferred embodiment of the invention has been described, the invention is to be limited only by the following claims and equivalents thereof.

What is claimed is:

1. A portable tool tray comprising, in combination:

(a) a formed receptacle having a circumferential side, a bottom, and a circumferential rim, said rim including an outwardly extending ledge, downwardly extending retainer clips integrally formed in the ledge of the rim, said clips positioned at intervals about the circumference of the rim and spaced laterally from the side of the receptacle;

(b) a flexible bag of bag material with a closed loop edge, said edge having a thickness exceeding the thickness of the bag material, adjacent the loop edge;

(c) bag fill in the bag; and (d) a circumferential retainer ring including an inside and outside, a recess on one side, said ring retained by the retainer clips with the loop edge of the bag in the ring recess and the bag extending between the ring and a side of the receptacle and fitted over the bottom of the receptacle.

2. The tray of claim 1 wherein the receptacle includes formed dividers.

3. The tray of claim 1 wherein the receptacle is a formed plastic.

4. The tray of claim 1 wherein the ring has a uniform cross section which is generally rectangular with a recess on the inside.

5. The tray of claim 1 wherein the bag fill material comprises plastic beads.

6. The tray of claim 1 further including a magnetic material within the formed receptacle.

7. The tray of claim 1 wherein the retainer ring includes a series of slots in the outside edge of the ring and said clips are fitted into the slot to retain the ring.

8. The tray of claim 7 wherein the ring includes a recess in each for receiving and engaging a clip to retain the clip.

* * * * *